US009457250B1

(12) United States Patent
Jenkins

(10) Patent No.: US 9,457,250 B1
(45) Date of Patent: Oct. 4, 2016

(54) OBJECT TOSSING GAME

(71) Applicant: Raymond L. Jenkins, Dripping Springs, TX (US)

(72) Inventor: Raymond L. Jenkins, Dripping Springs, TX (US)

( * ) Notice: Subject to any disclaimer, the term of this patent is extended or adjusted under 35 U.S.C. 154(b) by 0 days.

(21) Appl. No.: 14/847,635

(22) Filed: Sep. 8, 2015

Related U.S. Application Data

(60) Provisional application No. 62/064,210, filed on Oct. 15, 2014.

(51) Int. Cl.
*A63B 67/06* (2006.01)
*A63B 63/00* (2006.01)

(52) U.S. Cl.
CPC ..... *A63B 67/06* (2013.01); *A63B 63/00* (2013.01); *A63B 2225/605* (2013.01)

(58) Field of Classification Search
CPC ..... A63B 67/06; A63B 2067/063; A63B 2067/065; A63B 2225/605; A63B 2225/62; A63B 2225/60; A63B 63/00; A63B 67/007; A63F 2250/205; A63F 2250/0407; A63F 2250/04; A63H 23/10
USPC ..... 273/349, 350, 398–402
See application file for complete search history.

(56) References Cited

U.S. PATENT DOCUMENTS 3,403,907 A 10/1968 Keller
4,127,271 A * 11/1978 Moustakas ..... A63B 67/06 273/336
4,982,966 A * 1/1991 Teafatiller ..... A63B 67/06 273/336
4,986,549 A * 1/1991 Kuhtic ..... A63B 67/06 273/402
5,018,745 A * 5/1991 Dunse ..... A63F 9/0208 273/338
5,318,307 A * 6/1994 Bouchard ..... A63B 67/06 273/271
5,344,156 A * 9/1994 Levin ..... A63F 7/045 273/350
5,553,862 A 9/1996 Konotopsky
5,632,490 A * 5/1997 Brown ..... A63F 7/048 273/138.3
5,882,010 A * 3/1999 Geror ..... A63B 67/06 273/400
6,004,219 A * 12/1999 Peabody ..... A63B 67/02 473/157
6,030,300 A * 2/2000 Zheng ..... A63B 9/00 135/125
D428,061 S 7/2000 Billodeau et al.
6,464,226 B1 10/2002 Kephart
(Continued)

*Primary Examiner* — Mark Graham

(74) *Attorney, Agent, or Firm* — Robert C. Montgomery; Montgomery Patent & Design LP.

(57) ABSTRACT

An object tossing game includes a portable receiving board and a container. The container defines a reservoir containing a volume of water. The board is positioned within the container and floats atop the water. The board is constructed out of a buoyant material and includes at least one (1) receiving aperture. The board also includes a catch pocket positioned below the receiving aperture to catch and hold game pieces received by the aperture. The water provides a force dampener when the thrown game piece impacts a surface of the board.

15 Claims, 4 Drawing Sheets

(56) References Cited

U.S. PATENT DOCUMENTS 6,957,960 B2 * 10/2005 Lewellen ..... G09B 23/12 273/350
6,959,926 B2 * 11/2005 Melchiorri ..... A63F 3/00895 273/109
7,134,662 B2 * 11/2006 Menendez ..... A63B 67/06 273/400
7,360,767 B2 * 4/2008 Merccica ..... A63B 67/06 273/350
7,500,674 B2 3/2009 Riley et al.
8,162,318 B1 4/2012 Peterson et al.
8,657,293 B2 2/2014 Sindaco
2002/0175469 A1 * 11/2002 Kessler, Jr. ..... A63B 67/06 273/400
2004/0108658 A1 * 6/2004 Bartel ..... A63B 67/06 273/398
2005/0051968 A1 * 3/2005 Froesel ..... A63B 67/06 273/336
2006/0247072 A1 11/2006 Combs et al.
2007/0045964 A1 * 3/2007 Petras ..... A63B 63/00 273/317
2008/0143052 A1 * 6/2008 Paslawski ..... A63B 63/007 273/350
2009/0200742 A1 * 8/2009 Maietta ..... A63B 63/08 273/401
2012/0049458 A1 * 3/2012 Yokie ..... A63B 63/007 273/350
2014/0349774 A1 * 11/2014 Pennington ..... A63B 69/3661 473/174
2015/0061225 A1 * 3/2015 Sciandra ..... A63B 67/06 273/400

* cited by examiner

OBJECT TOSSING GAME

RELATED APPLICATIONS

The present invention was first described in and claims the benefit of U.S. Provisional Application No. 62/064,210 filed Oct. 15, 2014, the entire disclosures of which are incorporated herein by reference.

FIELD OF THE INVENTION

The present invention relates generally to an object tossing game including tossing projectiles at a portable target receiving board floating within a container.

BACKGROUND OF THE INVENTION

Older people often remember with great fondness the games of their youth. Neighborhood children would often play tag, board games, baseball, badminton, horseshoes, and darts. While some of those games are still popular they are not as popular as they once were.

One (1) reason for the decline in popularity of these older games is that today's children, and even some adults, are more influenced by fast action computer games, movies, and other such activities that incorporate sound and light effects. However, some of the older games combined elements of both competition and skill that are difficult to replicate on a computer and if given a try would compete well with today's modern games.

One (1) such game incorporates tossing a projectile towards a receiving board that floats on a volume of water within a container. A successful toss, when the projectile passes into the target, results in a score. There are many different ways to determine who wins such a game and can be implemented as follows: high score, first to a score, or first to accumulate a given score are some of the possibilities.

The challenge of simply tossing a projectile towards a target should not be underrated. It can be remarkably challenging and fun, and if a player becomes too skilled the difficulty can be increased simply by moving the game further away from the player(s), establishing a boundary, or other rules geared towards increasing the game's difficulty. Accordingly, there exists a need for a game which incorporates tossing a projectile towards a receiving board in a manner which is simple while challenging, adaptable with respect to difficulty and most importantly fun.

SUMMARY OF THE INVENTION

The inventor has recognized the aforementioned inherent problems and lack in the art and observed that there is a need for an object tossing game that comprises tossing projectiles at a portable target receiving board floating within a container.

It is therefore an object of the invention to provide a game, comprising at least one (1) target. Each target comprising a container, a board assembly residing within the container and at least one (1) game piece. Each game piece is adapted to be tossed towards the target. The container further comprises a reservoir having a rim around an upper perimeter and tapering sidewalls to a bottom wall. The board assembly comprises a laminated structure including buoyant layers affixed to a rigid frame layer, a target aperture extending through each of the buoyant layers and the frame layer, and a pocket affixed to a bottom of the board assembly and aligned with the target aperture. The target aperture is sized slightly larger than a diameter of each game piece. The buoyant layers include an upper padded layer, a lower padded layer affixed to a bottom surface of the upper padded layer and affixed to an upper surface of the frame layer, and a hydrodynamic dampening foam layer affixed to a bottom surface of the frame layer. The reservoir has at least one handle integrally molded into the rim. The target aperture is circular in cross-section. Each container may also be adapted to receive a volume of water therein. Each individual board assembly may also be adapted to be placed within the container and float on the volume of water therein.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
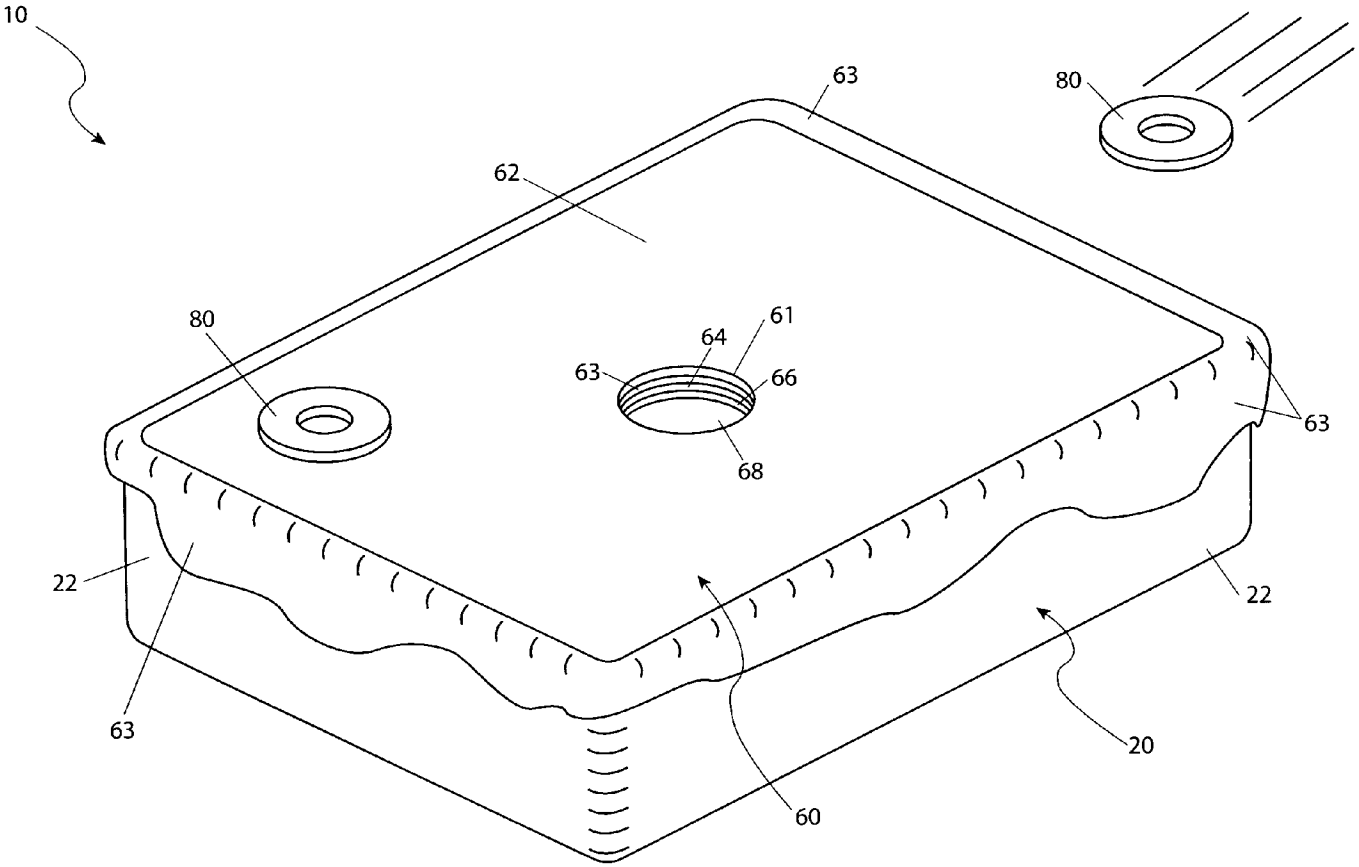
FIG. 1 is a perspective view of an object tossing game 10, according to a preferred embodiment of the present invention.

10 object tossing game
20 container
22 reservoir
24 rim
26 handle
30 water
60 board assembly
61 target aperture
62 upper padded layer
63 lower padded layer
64 frame layer
66 foam layer
68 fabric pocket
70 fastener
75 gap
80 game piece
100 player

DETAILED DESCRIPTION OF THE PREFERRED EMBODIMENT

Figure 2A:
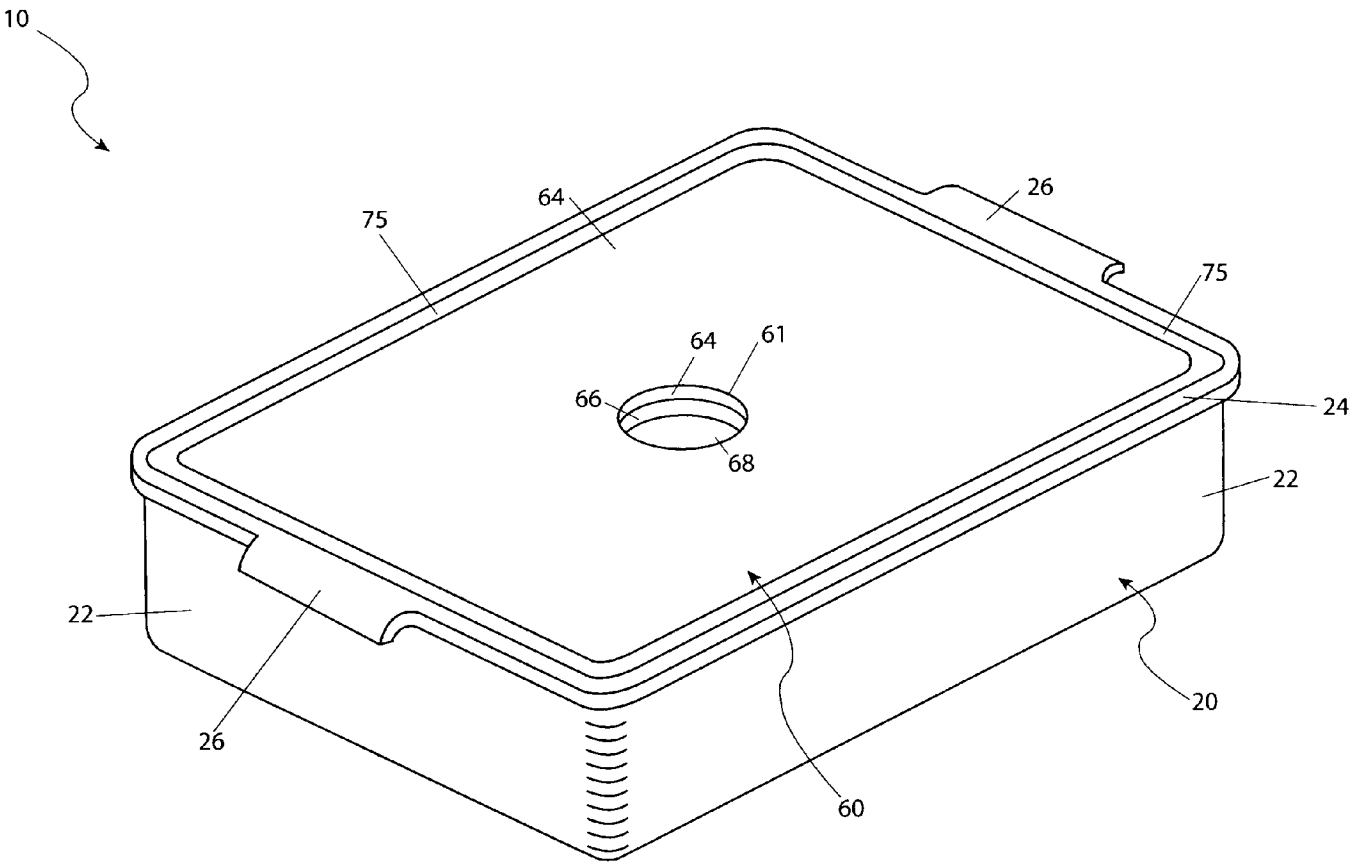
FIG. 2*a* is a perspective view of the object tossing game 10 depicting removal of upper padded layer 62 and lower padded layer 63 portions, according to a preferred embodiment of the present invention.
Figure 2B:
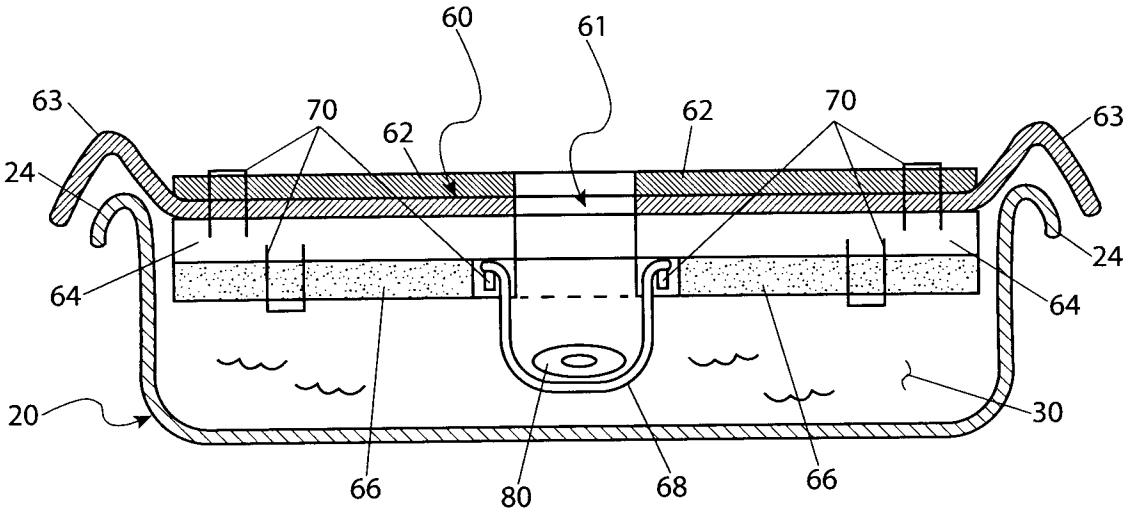
FIG. 2*b* is a sectional view of the object tossing game 10 taken along section line A-A (see FIG. 3), according to a preferred embodiment of the present invention; and, FIG. 3 is an environmental view of the object tossing game 10 depicting an in-use state, according to a preferred embodiment of the present invention.
Figure 3:
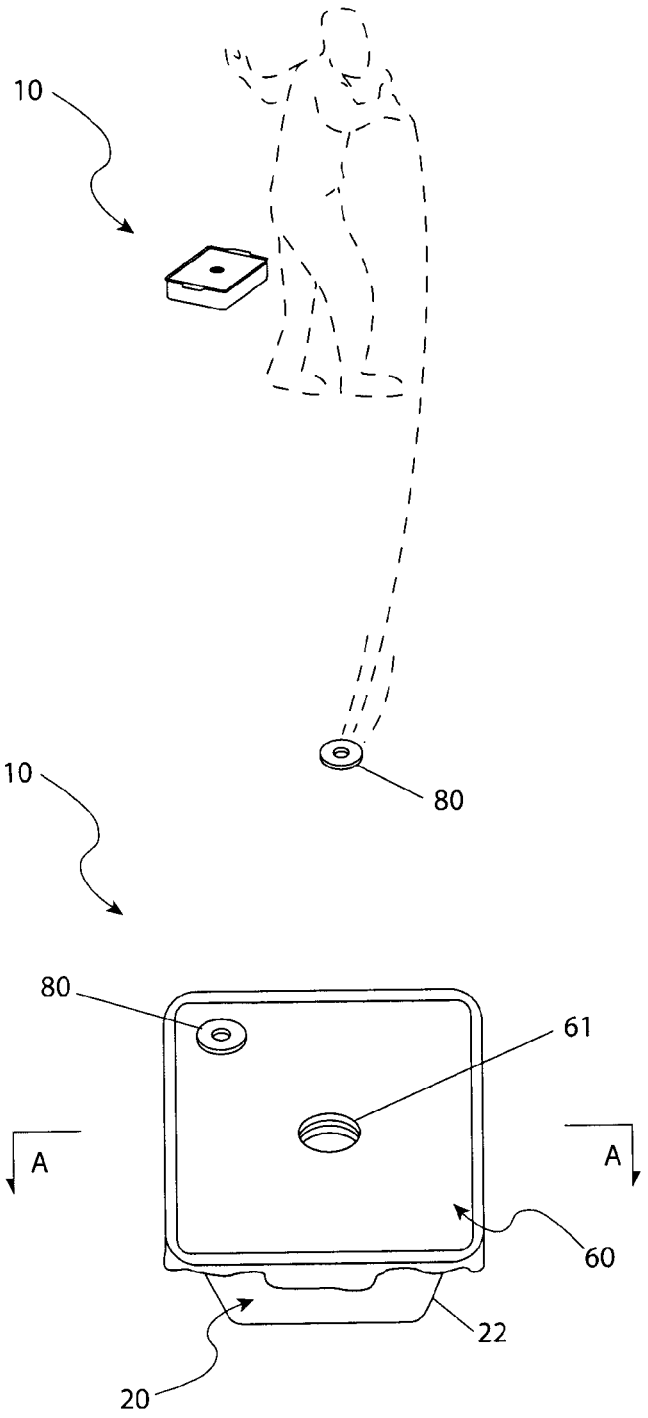

The best mode for carrying out the invention is presented in terms of its preferred embodiment, herein depicted within FIGS. 1 through 3. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes an object tossing game (herein described as the "game") 10, which provides a means for improved control of a thrown game piece 80 upon landing upon a game board 60 via the utilization of a hydrodynamic shock-absorbing construction.

Referring now to FIGS. 1, 2*a*, and 2*b*, perspective and sectional views of the game 10, according to the preferred embodiment of the present invention, are disclosed. The game 10 includes a pair of containers 20, a pair of board assemblies 60, and a plurality of washer-shaped game pieces 80.

The containers 20 and board assemblies 60 are positioned at a distance from each other as players 100 toss the washer-shaped game pieces 80 onto an opposing board assembly 60 in a similar manner as the game of "washers".

The board assembly 60 is made up of a buoyant laminated structure including buoyant layers which are affixed to a rigid frame layer 64 made of wood, plastic, or equivalent rigid buoyant material using fasteners 70 such as staples, screws, rivets, or the like. A preferred embodiment of the board assembly 60 is approximately sixteen inches (16 in.) width and approximately twenty-two inches (22 in.) in length; however, it is understood that various models of the game 10 may be introduced having actual sizes and shapes based upon a skill level of a player 100 and other user preferences, and as such should not be interpreted as a limitation of scope. The board assembly 60 includes an upper padded layer 62, a lower padded layer 63 affixed to a bottom surface of the upper padded layer 62 and affixed to an upper surface of the frame layer 64, and a hydrodynamic dampening foam layer 66 affixed to a bottom surface of the frame layer 64. The upper padded layer 62 and a lower padded layer 63 portions, are made using materials such as but not limited to, sections of carpeting, attached to an upper surface of the frame layer 64, and a hydrodynamic dampening foam layer 66 affixed to a bottom surface and made using a material such as polystyrene, urethane foam, or other hydraulic dampening material, also affixed using fasteners 70.

The board assembly 60 further includes a target aperture 61 having a circular cross-section approximately three inches (3 in.) in diameter, which extends entirely through the board assembly 60 into which the player 100 attempts to throw the game piece 80 into during play. The target aperture 61 is centrally located within the board assembly 60. The target aperture 61 is to be sized slightly larger than the game piece 80, thereby allowing the game piece to descend through the target aperture 61 and be received into a subjacent fabric pocket 68 being affixed to a bottom surface of the board assembly 60 using additional fasteners 70. The fabric pocket 68 is to be centered upon a bottom opening portion of the target aperture 61.

The container 20 provides a shallow rectangular reservoir 22 having rounded corner portions and being approximately three inches (3 in.) in depth. The reservoir 22 is preferably made of a plastic material and having integrally-molded rim 24 and handle 26 portions likewise being integrally-molded into rim 24. Additionally, the reservoir 22 is preferably tapered to allow for compact stacked storage of the reservoirs 22 when the game 10 is not in use. The container 20 provides an open top portion being sized and shaped to receive the board assembly 60 within, so as to result in a small gap 75 of approximately one-quarter on an inch (¼ in.) all around between the container 20 and board assembly 60 which is in turn covered over by the lower padded layer 63 which extends outwardly, and is draped over the rim portion 24 of the reservoir 22.

FIG. 2*a* provides a view of the apparatus 10 having the upper padded layer 62 and lower padded layer 63 portions removed to better illustrate the relationship between the container 20 and the frame layer 64.

During preparation for play, the container 20 receives a volume of water 30 approximately one inch (1 in.) deep. The board assembly 60 is then inserted into the open top of the container 20 so as to float upon the water 30. The game 10 provides a dampened landing of the game piece 80 due to the dampening effect caused by the construction of the board assembly 60 and the water 30. The dampened landing of the game pieces 80 prevents uncontrolled bouncing of the game pieces 80 during play, thereby providing a more enjoyable experience.

Referring now to FIG. 3, an environmental view of the game 10, according to the preferred embodiment of the present invention, is disclosed. The game 10 is envisioned to be played using similar rules as popular tossing games such as "washers", "horseshoes", or the like. The containers 20 are envisioned being spaced apart approximately twenty-one feet (21 ft.), having a player 100 or players 100 positioned adjacent to one (1) container 20 and pitching the game pieces 80 at a distant board assembly 60. The scoring of the game 10 is envisioned to vary based upon particular game rules and may include scoring based upon game events such as, but not limited to: a game piece 80 entering the target aperture 61, a game piece 80 partially covering the target aperture 61, and so on. It is further envisioned that the game 10 would continue until a player obtains a previously agreed upon number of points required to win the game.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the game 10, it would be installed as indicated in FIGS. 1 through 3.

The method of installing and preparing the game 10 for play may be achieved by performing the following steps: procuring the game 10; filling the reservoir 22 of each container 20 with approximately one inch (1 in.) of water 30; placing respective board assemblies 60 into the open top portions of each container 20; allowing the board assemblies 60 to float upon the water 30; draping the lower padded layer 63 up and over the rim portion 24 of the reservoir 22; and, placing the containers 20 upon a ground surface being spaced apart approximately twenty-one feet (21 ft.). The game 10 is now ready for play.

It is also envisioned that the board assemblies 60 may be submerged into the water 30 by a user 100 prior to play or submerged periodically during play to provide "swamping" of the upper padded layer 62 to produce a desired dampening effect.

The playing of the game 10 may be performed by the following steps: positioning a player 100, or team of players 100, adjacent to one (1) or both containers 20; pitching the game pieces 80 at the distant board assembly 60; counting accumulated scoring for each player 100 or team based upon game events such as, but not limited to: a game piece 80 entering the target aperture 61, a game piece 80 partially covering the target aperture 61, and so on; allowing the combined hydrodynamic effect of the board assembly 60 and the water 30 to dampen the contact of the game piece 80 upon contacting the board assembly 60; continuing to remove game pieces 80 from the board assembly 60 and/or fabric pocket 68 as needed; alternating a direction of pitching the game pieces 80; repeating the previously described pitching of the game pieces 80 until a player 100 or team obtains a previously agreed upon number of points required to win the game 10; and, benefiting from the dampened landing of the game pieces 80, thus preventing uncontrolled bouncing of the game pieces 80, thereby providing a user 100 of the present invention 10 a more enjoyable experience afforded a user 100 of the present invention 10.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A game, comprising:
at least one target, each comprising:
a container;
a board assembly residing within said container; and,
at least one game piece;
wherein said board assembly comprises:
a laminated structure including buoyant layers affixed to a rigid frame layer;
a target aperture extending through each of said buoyant layers and said frame layer; and,
a pocket affixed to a bottom of said board assembly and aligned with said target aperture;
wherein said target aperture is sized slightly larger than a diameter of each game piece;
wherein each said game piece is adapted to be tossed towards said target.

2. The game of claim 1, wherein said container further comprises a reservoir having a rim around an upper perimeter and tapering sidewalls to a bottom wall.

3. The game of claim 1, wherein said buoyant layers include:
an upper padded layer;
a lower padded layer having a first side affixed to a bottom surface of said upper padded layer and a second side affixed to an upper surface of said frame layer; and,
a hydrodynamic dampening foam layer affixed to a bottom surface of said frame layer.

4. The game of claim 2, wherein said reservoir has at least one handle integrally molded into said rim.

5. The game of claim 1, wherein said target aperture has a circular cross-section.

6. A game, comprising:
at least one target, each comprising:
a container;
a board assembly residing within said container; and,
at least one game piece;
wherein said board assembly comprises:
a laminated structure including buoyant layers affixed to a rigid frame layer;
a target aperture extending through each of said buoyant layers and said frame layer; and,
a pocket affixed to a bottom of said board assembly and aligned with said target aperture;
wherein said target aperture is sized slightly larger than a diameter of each game piece;
wherein each container is adapted to receive a volume of water therein; and,
wherein each said game piece is adapted to be tossed towards said board assembly.

7. The game of claim 6, wherein said container further comprises a reservoir having a rim around an upper perimeter and tapering sidewalls to a bottom wall.

8. The game of claim 6, wherein said buoyant layers include:
an upper padded layer;
a lower padded layer having a first side affixed to a bottom surface of said upper padded layer and a second side affixed to an upper surface of said frame layer; and,
a hydrodynamic dampening foam layer affixed to a bottom surface of said frame layer.

9. The game of claim 7, wherein said reservoir has at least one handle integrally molded into said rim.

10. The game of claim 6, wherein said target aperture has a circular cross-section.

11. A game, comprising:
at least one target, each comprising:
a container;
a board assembly residing within said container; and,
at least one game piece;
wherein said board assembly comprises:
a laminated structure including buoyant layers affixed to a rigid frame layer;
a target aperture extending through each of said buoyant layers and said frame layer; and,
a pocket affixed to a bottom of said board assembly and aligned with said target aperture;
wherein said target aperture is sized slightly larger than a diameter of each game piece;
wherein each container is adapted to receive a volume of water therein;
wherein said individual board assembly is adapted to be placed within said container and floats on said volume of water; and,
wherein each said game piece is adapted to be tossed towards said board assembly.

12. The game of claim 11, wherein said container further comprises a reservoir having a rim around an upper perimeter and tapering sidewalls to a bottom wall.

13. The game of claim 11, wherein said buoyant layers include:
an upper padded layer;
a lower padded layer having a first side affixed to a bottom surface of said upper padded layer and a second side affixed to an upper surface of said frame layer; and,
a hydrodynamic dampening foam layer affixed to a bottom surface of said frame layer.

14. The game of claim 12, wherein said reservoir has at least one handle integrally molded into said rim.

15. The game of claim 11, wherein said target aperture has a circular cross-section.

* * * * *